United States Patent [19]

Bergen

[11] Patent Number: 4,762,997

[45] Date of Patent: Aug. 9, 1988

[54] FLUID JET ASSISTED ION PROJECTION CHARGING METHOD

[75] Inventor: Richard F. Bergen, Ontario, N.Y.

[73] Assignee: Xerox Corporation, Stamford, Conn.

[21] Appl. No.: 556,730

[22] Filed: Nov. 30, 1983

[51] Int. Cl.[4] ..... G03G 15/02

[52] U.S. Cl. ..... 250/326; 250/324; 361/229; 355/3 CH

[58] Field of Search ..... 250/324, 325, 326; 361/229; 355/3 CH

[56] References Cited

U.S. PATENT DOCUMENTS

| | | | |
|---|---|---|---|
| 2,890,633 | 6/1959 | Huebner | 250/326 X |
| 3,382,360 | 5/1968 | Young et al. | 250/49.5 |
| 3,471,695 | 10/1969 | Hudson et al. | 250/49.5 |
| 3,495,269 | 2/1970 | Mutschler et al. | 346/74 |
| 3,566,110 | 2/1971 | Gillespie et al. | 250/49.5 |
| 3,660,656 | 5/1972 | Frank et al. | 250/326 |
| 3,715,762 | 2/1973 | Magill et al. | 346/74 ES |
| 3,725,951 | 4/1973 | McCurry | 346/74 ES |
| 3,742,516 | 6/1973 | Cavanaugh et al. | 346/74 R |

FOREIGN PATENT DOCUMENTS

| | | |
|---|---|---|
| 1214962 | 12/1970 | United Kingdom . |
| 1220745 | 1/1971 | United Kingdom . |
| 1227996 | 4/1971 | United Kingdom . |
| 1238689 | 7/1971 | United Kingdom . |
| 1366715 | 11/1974 | United Kingdom . |
| 1406014 | 11/1975 | United Kingdom . |

*Primary Examiner*—Bruce C. Anderson
*Assistant Examiner*—Jack I. Berman
*Attorney, Agent, or Firm*—William A. Henry, II

[57] ABSTRACT

A fluid jet assisted method for charging a receptor surface to a predetermined voltage includes the steps of generating ions in a chamber, entraining the ions in a rapidly moving fluid stream passing into, through and out of the chamber, depositing the ions on a charge receptor and biasing the back of the charge receptor with a bias equal to and of opposite potential of said predetermined voltage desired on the receptor surface. Both the ion generator and the receptor can be stationary for charging receptor plates or the like, or the receptor could be a moving belt or the like.

14 Claims, 4 Drawing Sheets

FLUID JET ASSISTED ION PROJECTION CHARGING METHOD

This invention relates to improved methods for depositing a corona charge on a recipient member such as a xerographic surface.

In practice of xerography, a xerographic surface comprising a layer of photoconductive insulating material affixed to a conductive backing is used to support electrostatic images. In the usual method of carrying out the process, the xerographic surface is electrostatically charged uniformly over its surface and then exposed to a light pattern of the image being reproduced to thereby discharge the charge in the areas where light strikes the surface. The undischarged areas of the surface thus form an electrostatic charge pattern in conformity with the configuration of the original light pattern.

The latent electrostatic image can then be developed by contacting it with a finely divided electrostatically attractable material such as a resinous powder. The powder is held in image areas by the electrostatic charges on the layer. Where the electrostatic field is greatest, the greatest amount of powder is deposited; and where the electrostatic field is least, little or no powder is deposited. Thus, the powder image is produced in conformity with the light image of the copy being reproduced. The powder is subsequently transferred to a sheet of paper or other surface and suitably affixed to thereby form a permanent print.

In automatic machines employing the principle of xerography, it is common to employ a xerographic member in the form of a cylindrical drum or belt. When the xerographic member is formed as a drum it can be continuously rotated past a plurality of stations capable of performing the various xerographic functions in an automatic cycle of operations.

It is usual to charge the xerographic surface with corona of a positive DC polarity by means of a corona generating device having a coronode wire insulatively supported near a conductive shield. The charge can also be negative for some systems. When the coronode is supplied with a potential at or above the corona threshold potential for the system, a quantity of ions in the form of a corona discharge are emitted from the coronode which can deposit uniformly onto the xerographic surface.

The most common form of xerographic charging apparatus in use today is that described in U.S. Pat. No. 2,836,725. This type of device includes a coronode wire or wires supported relatively close to the surface to be charged. A grounded metallic shield generally surrounds the electrode except for an elongated opening through which the charge is emitted towards the recipient surface. The shield is conductive and held at electrical ground so that the electrode wire may be readily held at potentials in excess of threshold. Since the shield is maintained at ground, most of the corona current emitted goes directly to the shield and only a small portion thereof is effective to charge the plate by movement through the opening. Small deviations in output current of such an electrode wire have little efect in varying the corona current delivered to the xerographic surface since the proportionate change in the total current for a given wire is comparatively small when the corotron is operated above threshold.

Inherent in xerographic charging apparatus of the type described above is the continuous presence of dust generated by the operation of the various xerographic processing stations. With prolonged continuous operation, it has been found that dirt, dust and extraneous toner particles accumulate on and about the interior of the corona generating apparatus to such an extent that the charging uniformity and efficiency thereof is substantially decreased. Foreign particles on the corona emitting wire also vary the output current of the device. This has necessitated frequent cleaning of corotrons in zerographic machinery.

In addition to the problem associated with cleanliness, it has long been known that the dissipation of the emitted corona through the grounded shield contributes to minimized efficiency of corona generating apparatus. While the use of a grounded conductive shield allows for minimized variations in the output current, the decreased efficiency caused by the grounded shields has long been a known and accepted by-product of this type of corona generating devices.

Previous air ion projection schemes as shown in Great Britain Pat. No. 1,406,014 and U.S. Pat. Nos. 3,725,951 and 3,742,516 disclose the use of a high voltage corotron for precharging a web receiver. Discharging in an imagewise fashion is accomplished with an opposite polarity high voltage unit. Thus, such systems require two high voltage power supplies.

A further problem with prior corona charging systems when used with high speed copiers having highly sensitive photoreceptors or light sensitive members is the possibility of some discharging of the charge receptor due to the normal glow from a corona wire energized at a high voltage. The fluid jet assisted ionic method of charging of the present invention alleviates the above-mentioned problems by providing an ion generation means adjacent a surface to be charged that includes a grounded conductive chamber and an elongated corona wire in the chamber that is connected to a high potential source. The wire is substantially surrounded by the chamber to thereby prevent impingement of sufficient light on the charge receptive surface that would discharge the same. Air pressure is supplied to the chamber in order to keep the charging system clean and transport ion emissions from the corona wire to the charge receptor surface.

A further advantage of the present charging system is that it is a scorotron in nature in that the ion charge from the corona wire is controlled by the bias placed on the charge receptor.

Other features of the present invention will become apparent as the following description proceeds and upon reference to the drawings in which.

Figure 1:
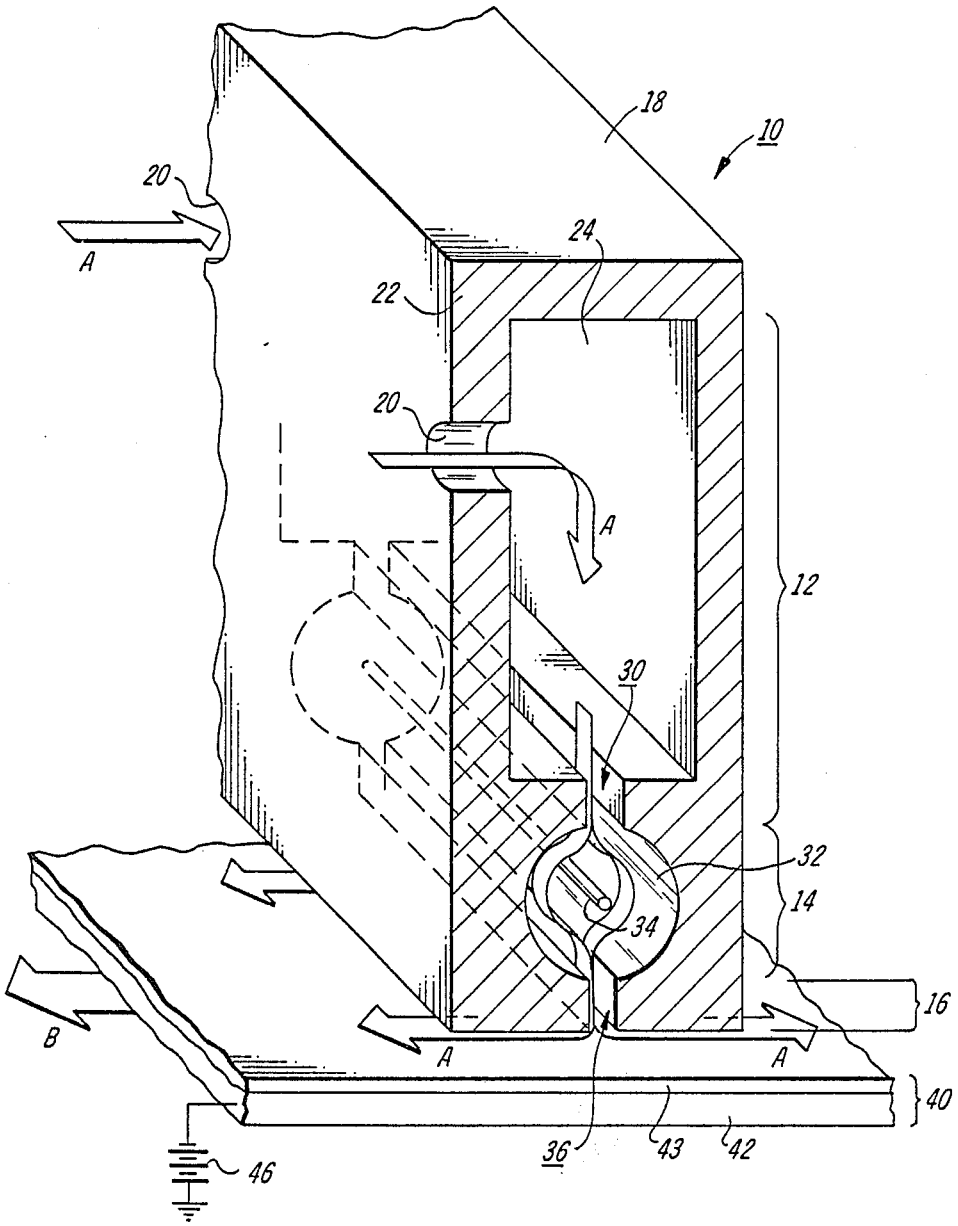
FIG. 1 is a perspective view of a fluid jet assisted ionc harging system according to the present invention.

While the invention will be described hereinafter in connection with preferred embodiments, it will be understood that no intention is made to limit the invention to the disclosed embodiments. On the contrary, it is intended to cover all alternatives, modifications, and equivalents as may be included within the spirit and scope of the invention as defined by the appended claims.

For a general understanding of the features of the invention, reference is had to the drawings. In the drawings, like reference numerals have been used throughout to designate identical elements.

A fluid transport ion charging device is shown in FIG. 1. Generally some of the charges produced at a corotron wire are carried out of a slit by moving air. They then come under the influence of a field between a receiver and jaws located on the lower part of the charging device. It has been found that (1) with both the receiver and jaws at ground, no measurable charges deposit on the receiver. For normal xerography, a grounded photoconductor will charge to saturation due to driving fields between the corona wire and the photoconductor substrate. However, (2) as with the present invention, a biased conductor, for example, at −450 volts DC, the receiver surface will charge and measure +450 volts DC, after the bias is removed. Since the relative voltages produce the fields to drive the ions, the receiver may be at ground, the jaws at an elevated positive voltage and the coronode at an elevated voltage. Charging for longer periods of time results in larger areas of a receiver being charged. Photoconductive surface voltages, at or near the applied bias is typically the case. This "scorotron" effect can be of substantial benefit when a photoconductor or receiver requires a specific voltage. Thus, in accordance with the present invention, a biased receiver is used in a method for charging a receiver in a fluid transport ion charging system, that is advantageous due to its simplicity, lower power supply costs, and the ability to obtain a desired charge level on a receiver surface.

With particular reference to the drawings, there is illustrated, by way of example, an ion charging device 10 comprising three operative zones; a fluid pressure distribution zone 12, an ion generation zone 14 and an ion exit zone 16. Although these three zones are shown occupying a common housing 18 (in FIG. 1) it should be understood that as long as the zones are properly, operatively interconnected, any number of specific configurations of the present invention are possible.

Several openings 20 pass through a side wall 22 of housing 18 for allowing an ionizable fluid, such as air, to be passed into a plenum chamber 24. A conventional air pump and suitable ducting may be connected to the openings 20. Pressurized air is allowed to escape from the plenum chamber 24 through metering inlet slit 30 into ion generation chamber 32 having electrically conductive walls, substantially surrounding corona generating wire 34, and out of the chamber 32 through exit slit 36. The entrance of the exit slit should be electrically conductive and at the same potential on each side of the slit.

Spaced fron the ion charging device 10, is a receiver 40 connected to a high potential source 46. The receiver comprises a planar charge receptor sheet 43 mounted on a conductive backing 42. The direction of fluid flow through the ion charging device and the direction of relative movement between the charging device and the charge receptor are indicated by the arrows A and B, respectively.

Figure 2:
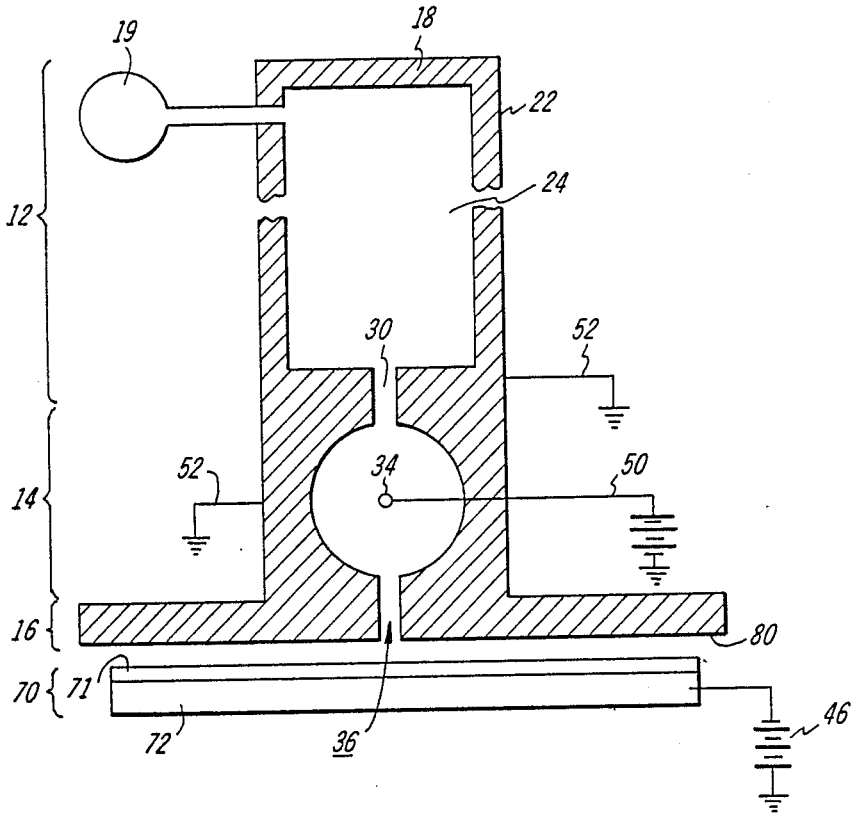
FIG. 2 is an elevational view of another embodiment of a fluid jet assisted ion charging system of the present invention for charging receptor surface in-situ.

As illustrated in FIG. 1, the housing 18 has been cut off at both ends, for clarity, but it should be understood that it has an aspect ratio such that its extent in the length direction (into the sheet) is substantially longer than its height and may be readily fabricated to any length, so that it may completely traverse a charge receptor sheet eleven inches wide, or even three feet wide. Since the corona generating wire 34 must span the entire length of the ion generation chamber 32 and must be in the same relationship to the chamber walls, for each increment of its length, suitable anchoring means will have to be provided between the end walls (not shown) and the wire for maintaining adequate tension, to prevent its sagging along its length. In order to ionize the air (or other ionizable fluid) around the wire for generating a uniform corona around each linear increment of the wire in the space between the wire and the housing, well known technology is applied. For example, as shown in FIG. 2, a high potential source 50 may be applied to the wire 34 and a reference potential 52 (ground) may be applied to the conductive housing 18. The ions, thus generated, will be attracted to the conductive housing where they will recombine into uncharged air molecules.

The right circular cylindrical geometry, shown for the ion generation chamber 32, is a preferred shape. However, as long as the chamber does not present the ion generator with any inwardly facing sharp corners or dicontinuities, which would favor arcing, the shape may assume other cross-sections. The preferred shape enables a uniform, high space charge density, ion fluid within the chamber since the high potential corona wire "sees" a uniform and equidistant surrounding reference potential on the walls of the cavity. As to the inlet and exit slits, 30 and 36, these extend parallel to the axial direction of the chamber and yield a uniform air flow over the corona generating wire 34 and out of the housing 18. Preferably, the slits are diametrically opposite to one another; however, it is possible to introduce air to or remove air from the chamber in other directions, or even to provide plural inlet slits.

As illustrated, the corona generating wire 34 is located along the axis of the cylindrical chamber 32. It has been found that if the wire is moved off axis and is placed closer to the outlet slit there is an increase in ion output from the ion device 10, because the space charge density in the region between the wire and the exit slit increases dramatically. It should be borne in mind that while increased ion output may be achieved, the sensitivity to arcing is increased with the reduced spacing. Also, wire sag and wire vibrations will become more critical with the reduced spacing. In any event, as set forth above, the wire should be parallel to the axis in order to provide output uniformity along the entire length of the ion projector.

In order for an ion projection apparatus to be practical, it is necessary to obtain an adequate space charge density in the output airflow. However, within the exit slit, similarly charged ions will repel one another and will be driven to the electrically grounded slit walls into whicht heir opposite charges have been induced, causing some of the air ions to recombine into uncharged air molecules. A desired increase in the ion exit rate (i.e. plate current) will be facilitated by an increase in the air flow itself, in a multi-fold manner. First, the fluid pressure head within the chamber 32, increases the electrical potential at which arcing will occur between the corona wire 34 and the conductive housing 18, thereby stabilizing the corona and yielding an increased space charge density within the chamber. Second, since the airflow entrained ions and sweeps them into and through the exit slit, the number of entrained ions swept into the exit airstream is proportional to the airflow rate. Third, a higher space charge is possible if the time each ion spends in the slit is made shorter (i.e. by increasing the rate of airflow, the ions have less time to neutralize), resulting in an increase in the output charge current with the air velocity for any given space charge.

With the system as described above, a method is shown whereby control is maintained of the charge on a photosensitive surface of a receiver by the bias that is placed on the conductive portion of the receiver. In this way, the charging system functions as a scorotron in that it only allows the charge placed on the photosensitive surface of the receiver to come up to the bias placed on the receiver and no more. Air keeps the system clean while the design of the conductive chamber 32 and ion exit slit 36 substantially reduces light that is produced from the glowing of wire 34 from discharging a highly sensitive selenium surface before the surface is imagewise exposed.

In reference to FIG. 2, an alternative embodiment of the present invention is shown that is used to charge an insulating or photoconductive surface in-situ, for example, medical or dental plates, etc. Normally, if one has a flat photoconductive plate, for example, selenium, and desires to charge the surface, a corotron or scorotron is scanned across the plate or alternatively the plate may be scanned past the charging unit. In the embodiment of the present invention shown in FIG. 2, the plate or receiver 70 and charging unit both remain stationary and charging still occurs. Air (1–60 psi) from pressure device 19 flowing past the corona wire 34 flushes charges away and quickly out of slit 36 ( 5 mils) to charge the insulating surface 71 to the biased potential of the receiver 70. The bias to the receiver is supplied by power source 46 which is connected to conductive member 72. If +300 VDC surface potential is needed, the receiver conductor is biased to −300 VDC. The region directly below the slit is immediately charged to the −300 VDC potential and repels further charge. The additional charges exiting the slit are repelled by the charged insulating surface and carried along by the fields and air stream to deposit to the left and right, as viewed in FIG. 2, on adjacent uncharged regions such that the charge area keeps expanding. From this, one can see the scorotron or charge control effect of the bias potential. This effect allows for all regions that are biased to receive and accept charge even though they are located at extreme distances, remote from the corona wire. This method of charging allows charges to be transported by the moving air to where they are needed.

The ground plane 80 is necessary to keep charges in a preferential field that drives them toward the receiver as they are transported by the fluid. By experimentation with the system shown in FIG. 2, a +5.5 volt bias was applied to the corona wire and −450 VDC to the aluminum conductive layer 72 which was mounted on a Mylar insulator and the member 80 was at ground. The high voltage was switched on for ½ second at 20 psi and all regions on the Mylar below the ground plane were charged to +450 volts when all bias was removed. A 0.015" wide slit charged a 2" wide region which was the area below the ground plane surface of jaws 80.

It is understood that voltages in this case can be altered as long as the voltage differences remain the same, producing identical fields. Therefore, the above example would produce similar results with the receiver conductive layer at ground potential, jaws 80 at +450 VDC and the corona wire at +5,950 VDC.

Figure 3:
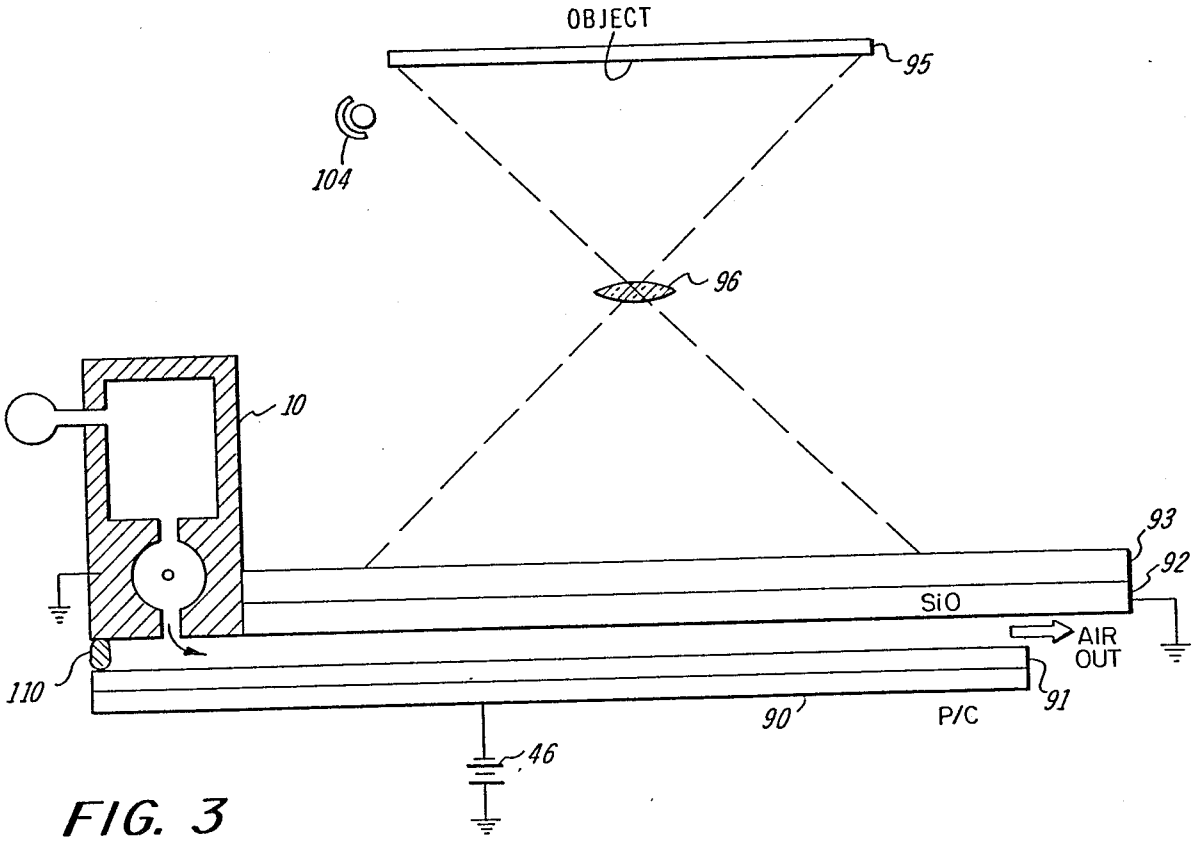
FIG. 3 is an elevational view of another embodiment of the present invention that allows for simultaneous charging and exposing.
Figure 4:
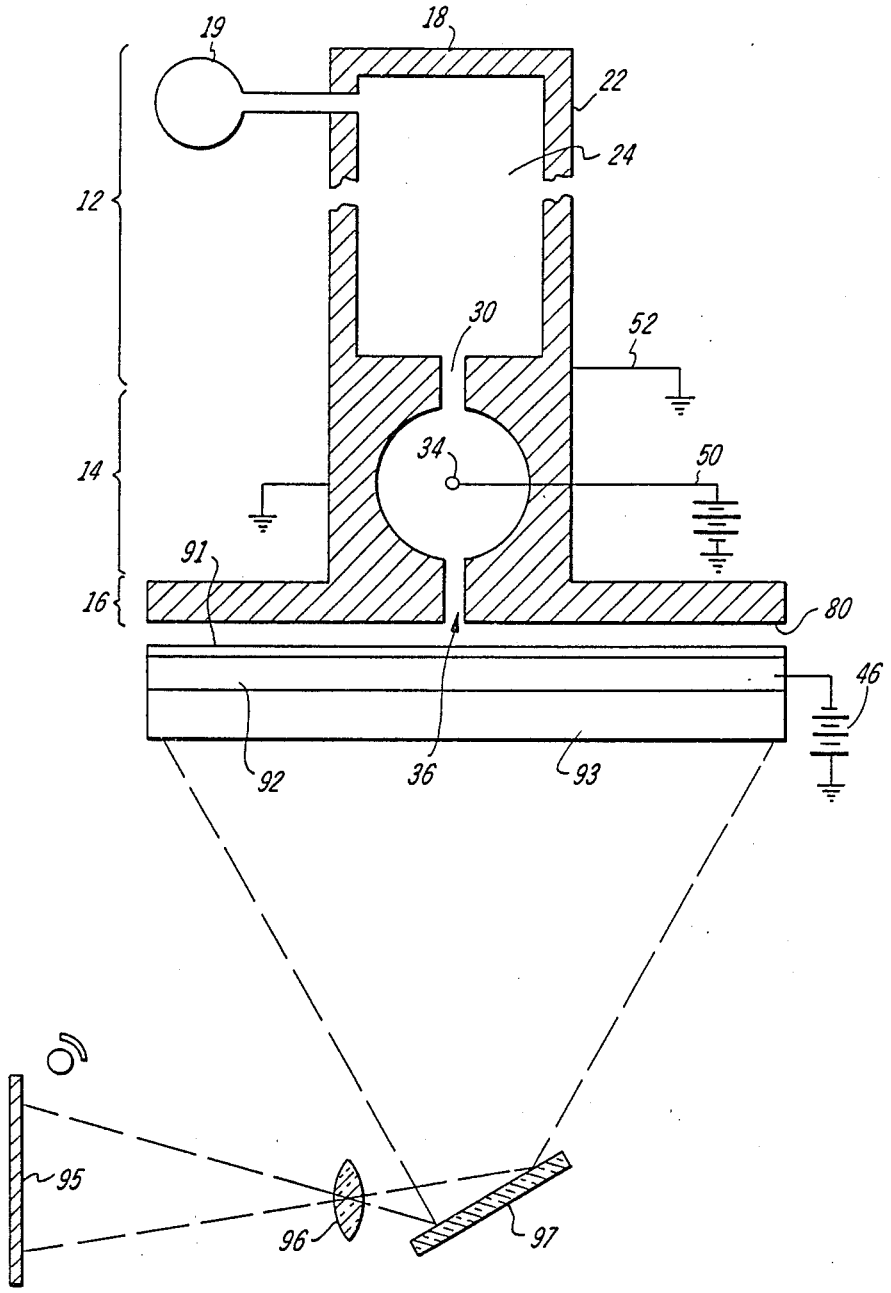
FIG. 4 is a side view of yet another embodiment of the present invention where simultaneous charging and exposure is accomplished.

FIGS. 3 and 4 disclose how a photoconductor or receiver with the method of in place charging, as shown in FIG. 2, allows for sequential or simultaneous exposure by employing Nesa glass for a ground plane. The glass may be moved after charge and exposure for further processing steps. For example, simultaneous charge and exposure is accomplished with the device of FIG. 4 by mounting a photoconductive layer 91 on a semi-transparent conductive layer of glass 93. A tin oxide coating 92 is applied on the surface of the glass opposite the lower surface of the photoconductor. This allows imaging from platen 95 through lens 96 and mirror 97 from the glass side as the photoconductive surface is simultaneously charged by charging device 10. Of course, this requires switching the image off and high voltage to corona wire 34 off at the same time. This is done by the use of a conventional switch in a timing circuit. Conversely, if one desired, charging unit 10 and image platen 95 could be switched ON and OFF sequentially by conventional means. Additional xerographic steps could be performed at other locations.

In reference to FIG. 3, simultaneous charging and exposing is accomplished by illuminating an object on platen 95 with lamp 104 with the image projecting through lens 96 onto Nesa glass 93 that is coated on its bottom surface with tin oxide 92. An air escape defined by seal 110 separates a photoconductor 91 from the tin oxide. the photoconductor is mounted on a conductive support 90 that is biased at 46. The photoconductor 91 is charged by ions from charging system 10 whereby the surface 91 can be simultaneously charged while being exposed by the image on platen 95 in the same manner as described in reference to FIG. 4.

While the invention has been particularly shown and described with reference to preferred embodiments thereof, it will be understood by those skilled in the art that various changes in form and details may be made therein without departing from the spirit and scope of the invention.

What is claimed is:

1. A fluid jet assisted ion projection method for charging a receiver to a uniform DC voltage, comprising the steps of:

providing a fluid supply means;

providing an ion generation means including a grounded conductive chamber and an elongate corona wire positioned in said chamber and connected to a high potential source that is adapted to apply a predetermined voltage to said corona wire, said chamber and said corona wire extending in a direction transverse to the direction of transport fluid flow;

providing ion entrainment means including inlet means for delivering transport fluid into said chamber and outlet means for directing transport fluid out of said chamber, said inlet means and said outlet means extending in said transverse direction, and biasing said receiver to said predetermined voltage with an opposite charge to ions emitted from said corona wire in order to control the charge level of the top surface of said receiver to a desired charge level.

2. The method of claim 1, wherein said receiver comprises a photosensitive material mounted on a conductive backing material.

3. A fluid jet assisted ion projection method for charging a receiver in-situ to a uniform DC voltage, comprising the steps of:

providing a fluid supply means;

providing a stationary ion generating means including a grounded conductive chamber and an elongated corona wire positioned in said chamber and connected to a high potential source, said chamber and said corona wire extending in a direction transverse to the direction of fluid transport;

providing stationary ion entrainment means including inlet means for delivering transport fluid into said chamber and outlet means for directing transport fluid out of said chamber, said inlet means and said outlet means extending in said transverse direction;

providing an ion guide means projecting outwardly from said outlet means for direction ions exiting said outlet means to all areas of said receiver;

applying a predetermined potential to said corona wire; and applying a bias equal to and of opposite potential of said predetermined potential to said receiver and thereby obtaining a charge on the surface of said receiver equal to said predetermined potential.

4. A fluid jet assisted method for charging a receptor surface to a desired predetermined uniform voltage, comprising the steps of:

(a) generating ions in a chamber;

(b) entraining said ions in a rapidly moving fluid stream passing into, through and out of said chamber;

(c) depositing said ions on said charge receptor surface; and (d) biasing the back of said charge receptor with a bias equal to and of opposite potential of said desired predetermined uniform voltage.

5. The method of claim 4, wherein said charge receptor is stationary while being charged.

6. The method of claim 4, wherein said charge receptor is moving while being charged.

7. The method of claim 4, wherein said ions are generated by applying a potential to a corona.

8. The method of claim 7, wherein contamination of said corona wire is minimized by said fluid stream passing thereon.

9. The method of claim 7, including the steps of minimizing discharge of said charge receptor due to light from said corona wire by defining a narrow exit in said chamber for ion emmisions from said corona wire.

10. A fluid jet assisted ion projection method for charging the top surface of a receiver in-situ to a uniform DC voltage, comprising the steps of:

providing a fluid supply means;

providing a stationary ion generating means including a grounded conductive chamber and an elongated corona wire positioned in said chamber and connected to a high potential source, said chamber and said corona wire extending in a direction transverse to the direction of fluid transport;

providing stationary ion entrainment means including inlet means for delivering transport fluid into said chamber and outlet means for directing transport fluid out of said chamber, said inlet means and said outlet means extending in said transverse direction;

applying a potential to said corona wire; and providing an ion guiding means projecting outwardly from said outlet means for directing ions exiting said outlet means to all areas of said receiver;

applying a bias equal to and of opposite potential of said uniform DC voltage to the bottom surface of said receiver and thereby obtaining a charge on the top surface of said receiver equal to the desired uniform DC voltage.

11. A method of simultaneously charging and exposing a photoconductor, comprising the steps of:

providing a glass member;

coating said glass member with tin oxide;

spacing a photoconductor a predetermined distance away froms aid glass member;

providing a corona charging means for charging said photoconductor to a predetermined voltage;

providing means for projecting an image through said glass to said photoconductor; and providing fluid supply means for applying fluid to said charging means in order to transport ions from said charging means to said photoconductor, whereby as said means for projecting an image is actuated, said charging means and said fluid supply means are simultaneously actuated in order to both charge and expose said photoconductor at the same time for subsequent transfer of said projected image to sheet material.

12. The method of claim 11, including the step of providing said photoconductor with a photoconductive surface and a conductive backing.

13. The method of claim 12, including the step of biasing said conductive backing to said predetermined voltage.

14. A fluid jet assisted ion projection method for charging a receiver to a uniform DC voltage, comprising the steps of:

providing a fluid supply means;

providing an ion generation means including a biased conductive chamber and an elongated corona wire positioned in said chamber and connected to a high potential source that is adapted to apply a predetermined voltage to said corona wire, said chamber and said corona wire extending in a direction transverse to the direction of transport fluid flow;

providing ion entrainment means including inlet means for delivering transport fluid into said chamber and outlet means for directing transport fluid out of said chamber, said inlet means and said outlet means extending in said transverse direction, and grounding said receiver in order to control the charge level on the top surface of said receiver at said predetermined voltage.

* * * * *